United States Patent [19]

Young

[11] Patent Number: 5,052,971

[45] Date of Patent: Oct. 1, 1991

[54] SOFT DOLL WITH MOVABLE LIMBS

[76] Inventor: Kenneth Young, 33 Hitching Post La., Glen Cove, N.Y. 11542

[21] Appl. No.: 636,490

[22] Filed: Dec. 31, 1990

[51] Int. Cl.[5] ..... A63H 3/46

[52] U.S. Cl. ..... 446/376; 446/379

[58] Field of Search ..... 446/268, 330, 339, 369, 446/370, 371, 373, 374, 375, 376, 379, 380, 382, 385, 390, 486, 489

[56] References Cited

U.S. PATENT DOCUMENTS

| | | | |
|---|---|---|---|
| 1,065,443 | 6/1913 | Granger | 446/376 |
| 1,273,469 | 7/1918 | Dun Lany . | |
| 1,552,348 | 9/1925 | Rosenthal | 446/369 X |
| 1,880,109 | 9/1932 | Sanders . | |
| 2,316,732 | 4/1943 | Weinstein | 446/379 |
| 2,544,135 | 3/1951 | Cohn | 446/384 |
| 2,644,272 | 7/1953 | Cohn . | |
| 2,653,415 | 9/1953 | Becker | 446/379 |
| 3,052,061 | 9/1962 | Beebe . | |
| 3,065,566 | 11/1962 | Sugimoto . | |
| 3,699,715 | 10/1972 | Lewis et al. | 446/376 |
| 3,816,957 | 6/1974 | Nakajima . | |
| 4,536,165 | 8/1985 | Maar | 446/153 |
| 4,662,857 | 5/1987 | Quinn et al. | 446/371 |
| 4,854,911 | 8/1989 | Berliner et al. | 446/376 |

*Primary Examiner*—Mickey Yu
*Assistant Examiner*—Sam Rimell
*Attorney, Agent, or Firm*—Richard M. Rabkin

[57] ABSTRACT

Structure for attaching arms and legs to the seamless torso skin of a soft doll includes a circular plug, having an annular groove extending around its circumference, which is placed inside the skin at a hip or shoulder location and there held in place by a locking disk having a circular flange which is pushed over the exterior surface of the skin and engages the annular groove of the interior plug and traps the body skin between the plug and the disk. The locking disk has an annular groove formed therein for receiving a complementarily shaped and dimensioned circular flange formed at the proximal end of a hollow limb member, whereby the limb member is rotatable with respect to the torso on mating bearing surfaces both formed of relatively durable materials.

12 Claims, 1 Drawing Sheet

SOFT DOLL WITH MOVABLE LIMBS

BACKGROUND OF THE INVENTION

1. Field of the Invention

This invention relates to articulated soft dolls and, more particularly, to an improved construction for joining the limbs to the torso of a soft doll.

2. Description of the Prior Art

The invention relates to so-called "soft dolls" having a torso formed of a thin, flexible material to which the limbs are affixed and then stuffed with an elastic material which insures that the body will return to its original shape each time it is subjected to shape-changing force.

U.S. Pat. No. 1,180,109 describes an early example of soft doll which has a fabric-covered torso stuffed with cotton batting, or the like, to which hollow limb members formed of soft, resilient rubber are attached. Each of the relatively rigid limbs is provided at the body end with an annular rib which forms a complementary groove or recess in a fabric covered plug inserted into the body end of the limb. The limb is attached to the torso by means of a pivot pin which extends through a pair of cooperating rigid discs, one of which is disposed within the plug at the body end of the member and the other is disposed underneath the fabric covering of the torso. In effect, the plug forms a limb stump which is movably jointed to the body by the pivot pin. However, the structure for achieving movability of the limbs with respect to the torso consists of many individual parts which appear rather difficult to assemble, which would add to the cost of manufacturing the doll.

The more recent soft doll described in U.S. Pat. No. 4,536,165 has a torso covered with a thin skin of latex rubber or soft polyvinyl chloride to which limb members are attached at shoulder and hip locations without piercing the skin. This is accomplished by forming the skin of the torso with relatively long closed extensions at the shoulders and hips to which the arms and legs are attached. In one embodiment, the limb is attached to the torso by pushing the outer surface of the closed extension over the body end portion of the limb member and securing the limb to the extension with a tight elastic ring disposed interiorly of the skin and engaging a ring-shaped groove formed in the outer surface of the limb member. In another embodiment, the arms and legs are attached to the body skin by a special coupling piece disposed interiorly of each closed extension; the coupling piece is circular in cross-section and has an annular groove extending around its circumference which interlockingly engages a circular inwardly directed flange on the proximal edge of a hollow arm or leg, as the case may be, when the body end is pushed over the skin enveloping the coupling piece. Assembly is facilitated, and damage to the skin minimized, by applying a lubricant to the exterior surface of the closed extension prior to attaching the limbs.

Both constructions permit the limbs to be rotated with respect to their respective stumps so that they can be positioned as desired during assembly of the doll. However, because the thin skin of the torso turns out to be the bearing surface on which the flange on the limb is rotatable and the limbs are made of heavier material than the torso skin, rotation of the limbs relative to the body subjects the skin, at the bearing surface, to damaging wear. Moreover, the relatively long stumps at the shoulder and hip portions formed by the closed extensions of the torso skin are unnatural in appearance and also cause unnatural motion when the arms and legs are rotated relative to their respective stumps.

SUMMARY OF THE INVENTION

The primary object of the present invention is to provide an improved construction for attaching the arms and legs to the skin of the torso of a soft doll which overcomes the described disadvantages of the prior art.

Another object is to provide a soft doll having limb members which are movable in a natural way with respect to the torso.

These and other objects are achieved according to the invention by forming the torso of the doll of a thin, flexible material such as latex rubber or soft polyvinyl chloride, by blow molding for example, in a closed mold so as to form a seamless body "sack" having molded-in areas in the form of shallow pockets which define shoulder and hip locations for receiving means for attaching the limbs to the torso. Each arm and leg is attached, before the body "sack" is stuffed, by inserting through the open neck and placing at a shoulder or hip location, as the case may be, flat circular plug having an annular groove extending around the circumference of its sidewall over which the thin, flexible body skin is stretched. A circular locking disk having a circular flange is pushed over the exterior surface of the skin and the flange engages the annular groove of the interior plug and traps the body skin between the plug and disk and secures the mating disks to the torso at a preselected desired location. The locking disk, too, has an annular groove extending around the circumference of its sidewall for receiving a complimentarily shaped and dimensioned circular flange formed at the proximal end of a hollow limb member formed of soft but relatively rigid polyvinyl chloride, for example. The flange is rotatable relative to the locking disk whereby the arms and legs may be arranged at any desired position during assembly or use, free of contact with the thin torso skin, which is trapped between and protected by the mating plug and locking disk. The mating bearing surfaces of the rotary joint are both formed of relatively heavy and durable materials so as to provide sturdy movable jointing of the limbs to the torso.

After the limbs are attached to the body "sack", the skin is stuffed with a soft elastic material such as polyester wool or shredded foamed plastic having inherent elasticity which gives the torso a natural shape and feel and insures that the body will retain its original shape.

Other objects, features and advantages of the invention, and a better understanding of its construction and operation, will be had from the following detailed description of a currently preferred embodiment, taken in conjunction with the accompanying drawings.

DETAILED DESCRIPTION OF THE PREFERRED EMBODIMENT

Figure 1:
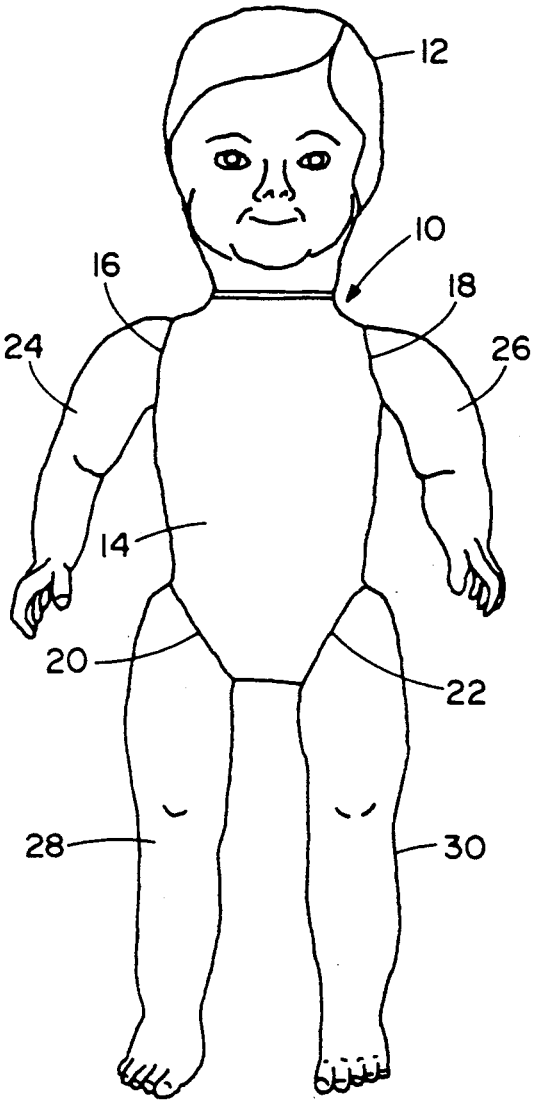
FIG. 1 is a pictorial view of a doll constructed in accordance with the invention.

The doll shown in FIG. 1 has a torso 10 with a skin 14 formed of a plastic material which is thin and flexible, and is preferably made of latex rubber or soft polyvinyl chloride, the thickness of which will depend on which plastic material is used. The torso is stuffed with a soft stuffing 15, for example, a soft fibrous material such as polyester wool or shredded foam plastic. The head 12, also covered with a plastic material, is joined in conventional fashion to an open neck portion of the torso skin 14.

During molding of the torso sack, which preferably is blow molded in a closed mold, the locations 16 and 18 where the arms are to be attached and the hip locations 20 and 22 where the legs are to be attached, are established by forming at each location a shallow, generally circular pocket having diameter's generally corresponding to the diameters of the body ends of the arms 24 and 26 connected at shoulder locations 16 and 18, respectively, and of the legs 28 and 30 connected at respective hip locations 20 and 22. The improved structure for connecting the arms and legs to the torso is illustrated in FIGS. 2 and 3, respectively; the structure being the same for the legs as for the arms, primed reference numerals are used in FIG. 3 to identify corresponding parts identified by unprimed reference numerals in FIG. 2.

Figure 2:
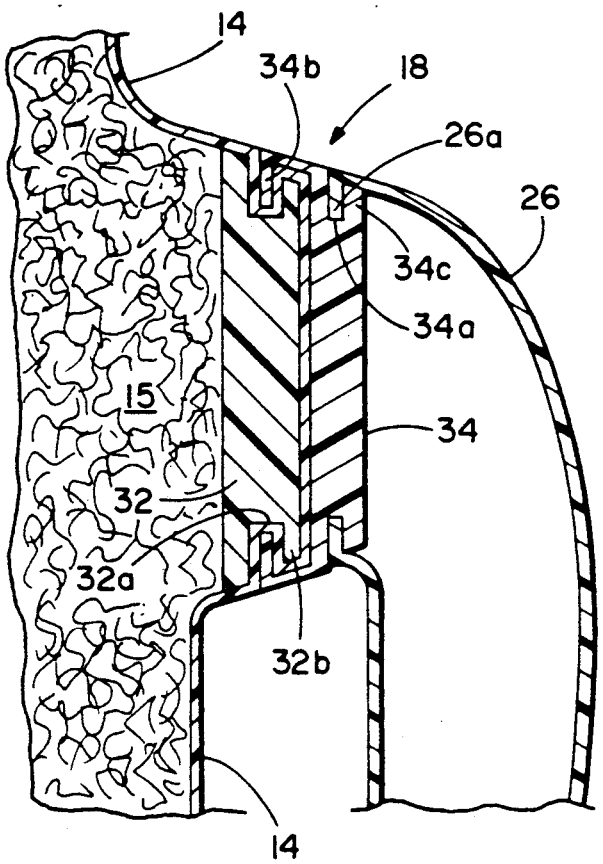
FIG. 2 is a fragmentary cross-sectional view of the shoulder region of the doll showing how an arm is joined to the body.
Figure 3:
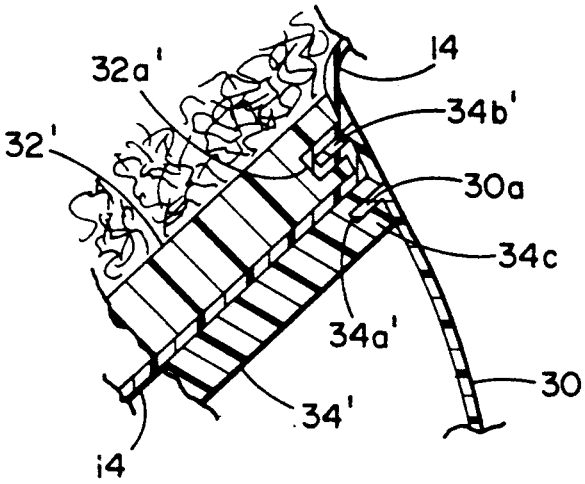
FIG. 3 is a fragmentary cross-sectional view of the hip portion of the doll showing how a leg is attached to the body.

As shown in FIG. 2, at shoulder region 18 of the torso skin 14 is stretched over a thin annular plug 32 formed of a relatively rigid plastic material such as ABS or Nylon, having opposed planar inner and outer surfaces and an annular groove 32*a* extending around its circumference, the plug having been inserted through the open neck of the yet unstuffed torso "sack". The plug 32 is retained at the desired location by a circular locking disk 34, also formed of ABS or Nylon, having opposed planar inner and outer surfaces and an annular groove 34*a* extending around its circumference approximately midway between the inner and outer surfaces. An integral circular flange 34*b* extends inwardly from the inner surface of the disk and is dimensioned to be pushed over the exterior surface of the skin and to interlockingly engage the annular groove 32*a* of the interior plug 32 and thereby trap the skin between the confronting planar surfaces of the plug and disk. The plug and disk are both formed of a material having sufficient resiliency to permit flange 34*b* to be readily pushed over the lip 32*b* defining the outer edge of the circumferential groove 32*a* on the plug and to snap into place in the groove. The shoulder and upper arm region is made to look more natural by making the diameter of the outer surface of plug 32 somewhat smaller than that of its inner surface, and to similarly taper the sidewall of locking disk 34, to provide a smooth sloping contour from the neck toward the shoulder.

The arms and legs are both formed of a suitable plastic material, preferably polyvinyl chloride having a thickness sufficient to make the limb relatively rigid yet smooth to the touch and may be hollow throughout its length, or alternatively, only at the proximal end with the balance solid. The hollow body end of each arm and leg is formed to have an integral, inturned circular flange 26*a* and 30*a*, respectively, having an inner diameter substantially equal to the diameter of the annular circumferential groove 34*a* formed in locking disk 34. To attach arm 26 or leg 30 to the torso, the open body end is pushed over the lip 34*c* which defines the outer edge of the groove whereupon it snaps into place within annular groove 34*a*. The materials of which locking disks 34 and 34' and the arms and legs are formed are sufficiently resilient that the flange 26*a* or 30*a*, as the case may be, can easily be pushed into engagement with the locking disk, yet rigid enough to make it difficult to disengage the flange from the annular groove. The locking disks 34 and 34' the flanges 26*a* and 30*a* both being circular in cross-section, the arm or leg, as the case may be, is rotatable about the longitudinal axis of the locking disk with the circumferential annular groove formed in the locking disk serving as the bearing surface, which is sufficiently rugged to withstand repeated movement of the extremities without undue wear.

After all four limbs are attached to the body "sack" in the manner described, the skin is stuffed, through the neck opening, with polyester wool or shredded foamed plastic, following which the head 12 is attached by suitable means known to the art.

Figure 4:
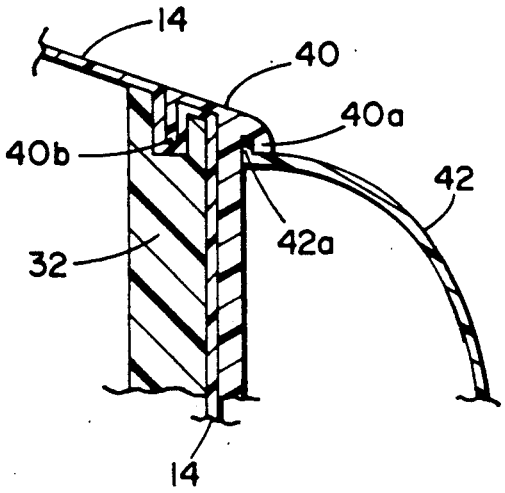
FIG. 4 is a fragmentary cross-sectional view of the shoulder region showing an alternative construction for joining the limbs to the body.

In the alternative construction of the connecting means shown in FIG. 4, the torso skin 14 is stretched over a thin annular plug 32, which is retained at the desired location on the torso by a circular locking disk 40. Like locking disk 34, it has an integral circular flange 40*b* which interlockingly engages the annular groove 32*a* of plug 32, but instead of having an annular groove extending around its circumference it has an inwardly directed circular flange 40*a* which with the outer surface of disk 40 defines an interior annular groove 40*b*. The body end of the limb 42 to be attached, which is hollow, is formed to have an integral outwardly directed circular flange 42*a* having an outer diameter substantially equal to the diameter of annular groove 40*b*, and is sufficiently resilient to easily be pushed into engagement with the locking disk. As in the other case, the limbs are rotatable with respect to the body on durable bearing surfaces isolated from the torso skin.

It will now be appreciated that this unique construction provides a soft doll with articulated arms and legs that may be posed in different positions and fully rotated, if desired, relative to the torso. Each connection between a limb and the body is durable and long-lasting and consists of only two simple parts which are easily manufactured and assembled.

I claim:

1. An articulated soft doll having arms and legs movably joined to a torso, comprising:

a thin flexible seamless skin on said torso having shoulder and hip locations;

a flat, circular plug disposed within said skin at each shoulder and hip location each having opposed inner and outer planar surfaces connected by a sidewall and having an annular groove extending around its circumference;

a flat circular locking disk for each circular plug each having opposed inner and outer planar surfaces connected by a sidewall, an annular groove formed therein, and a flange spaced inwardly from said inner surface interlockingly engaging the annular groove of a respective plug for trapping the skin of the torso between the plug and the locking disk and securing the locking disk at a respective shoulder or hip location of the torso; and arm and leg members each having a hollow proximal end and an integral circular flange at said proximal end for interfittingly engaging the annular groove of a respective locking disk for attaching said arm and leg members to said torso at shoulder and hip locations, respectively, for movement relative thereto.

2. A doll as claimed in claim 1, wherein the annular groove formed in each locking disk extends around its circumference, and wherein each arm and leg member has an integral inwardly directed circular flange at said proximal end for engaging the annular groove of a respective locking disk.

3. A doll as claimed in claim 1, wherein the annular groove formed in each locking disk is an interior annular groove defined in part by the outer planar surface of said locking disk, and wherein each arm and leg member has an integral outwardly directed circular flange at said proximal end for engaging the interior annular groove of a respective locking disk.

4. A doll as claimed in claim 2, wherein the sidewalls of said plug and of said locking disk are both tapered inwardly from the inner to the outer surface for providing a sloping contour from a neck portion of the torso toward the proximal end of the arm.

5. A dill as claimed in claim 1, wherein the flange at the proximal end of each arm and leg is formed of a relatively resilient plastic material adapted to be easily snapped into the annular groove formed in said locking disk, and wherein said skin comprises soft rubber.

6. A doll as claimed in claim 1, wherein said skin comprises soft polyvinyl chloride, said torso contains soft stuffing material, and the flange at the proximal end of said arms and legs is formed of relatively rigid polyvinyl chloride adapted to be easily snapped into engagement with the annular groove on said locking disk.

7. A doll as claimed in claim 1, wherein said skin comprises soft rubber having molded-in pockets at each shoulder and hip location, and said plug and said locking disk are formed of a relatively rigid plastic material and generally correspond to size to said molded-in pockets.

8. A doll as claimed in claim 5, wherein said plug and said locking disk are formed of Nylon.

9. A doll as claimed in claim 5, wherein said plug and said locking disk are formed of ABS plastic.

10. Construction for attaching a limb member to the thin flexible skin torso of a soft doll comprising:

a flat circular plug disposed within said skin at the desired location of a limb, said plug having opposed inner and outer planar surfaces connected by a sidewall and having an annular groove formed in said sidewall which extends around its circumference;

a flat circular locking disk for engaging said plug, said locking disk having inner and outer planar surfaces connected by a sidewall, an annular groove formed in said sidewall which extends around tis circumference, and an integral flange spaced inwardly from said inner planar surface for interlockingly engaging the annular groove of said plug and taping the skin of the torso between the plug and the locking disk and securing the locking disk to said torso at said desired location; and a limb member having a hollow proximal end and an integral inwardly directed circular flange at said proximal end for interfittingly engaging the annular groove formed in said locking disk for attaching said limb member to said torso for rotational movement relative thereto.

11. Construction according to claim 10, wherein said torso skin is formed of soft polyvinylchloride and the flange at the proximal end of said limb member is formed of relatively rigid polyvinyl chloride adapted to be easily snapped into the annular groove in said locking disk.

12. Construction according to claim 10, wherein said torso skin is formed of soft rubber, said plug and said locking disk are formed of a relatively rigid plastic material, and the flange at the proximal end of said limb member is formed of relatively rigid chloride adapted to be easily snapped into the annular groove in said locking disk.

* * * * *